US011369831B2

(12) United States Patent
Beck et al.

(10) Patent No.: US 11,369,831 B2
(45) Date of Patent: Jun. 28, 2022

(54) HIP THRUST BELT

(71) Applicant: Believe Pursue LLC, Los Angeles, CA (US)

(72) Inventors: Brett Andrew Beck, Los Angeles, CA (US); Hanna-Greta Kirber Beck, Los Angeles, CA (US); Eric Peterson, Madison, WI (US); Wang Pai Sheng, Taiwan (CN)

(73) Assignee: BELIEVE PURSUE LLC, Los Angeles, CA (US)

( * ) Notice: Subject to any disclaimer, the term of this patent is extended or adjusted under 35 U.S.C. 154(b) by 0 days.

(21) Appl. No.: 16/990,920

(22) Filed: Aug. 11, 2020

(65) Prior Publication Data

US 2022/0047910 A1 Feb. 17, 2022

(51) Int. Cl.

| | |
|---|---|
| ***A63B 21/00*** | (2006.01) |
| ***A63B 21/065*** | (2006.01) |
| ***A63B 23/04*** | (2006.01) |
| ***A63B 21/04*** | (2006.01) |
| ***A63B 21/072*** | (2006.01) |

(52) U.S. Cl.

CPC ..... *A63B 21/4009* (2015.10); *A63B 21/0442* (2013.01); *A63B 21/065* (2013.01); *A63B 21/0726* (2013.01); *A63B 23/0482* (2013.01); *A63B 2208/0247* (2013.01); *A63B 2209/10* (2013.01)

(58) Field of Classification Search

CPC ..... A63B 21/4009; A63B 21/0442; A63B 21/065; A63B 21/0726; A63B 23/0482; A63B 2208/0247; A63B 2209/10

See application file for complete search history.

(56) References Cited

U.S. PATENT DOCUMENTS

| | | | | |
|---|---|---|---|---|
| 116,904 A * | 7/1871 | Wiener | B68B 1/06 54/75 |
| 2,613,932 A * | 10/1952 | Manners | A63B 21/0552 482/124 |
| 3,751,031 A | 8/1973 | Yamauchi | |
| 3,877,426 A * | 4/1975 | Nirschl | A61F 13/108 602/62 |
| 3,910,577 A | 10/1975 | Boyle | |

(Continued)

FOREIGN PATENT DOCUMENTS

| | | |
|---|---|---|
| JP | 2005304917 | 11/2005 |
| JP | 2011196004 | 10/2011 |

OTHER PUBLICATIONS

PCT Notification of Transmittal of the International Search Report and Written Opinion dated Nov. 17, 2021 in related matter, PCT International Application No. PCT/US21/45450; 15 pages.

*Primary Examiner* — Garrett K Atkinson
(74) *Attorney, Agent, or Firm* — Cislo & Thomas, LLP

(57) ABSTRACT

A belt for use in performing hip raising exercises is provided. The hip thrust belt of the present invention comprises a flexible supporting pad coupled to a flexible belt. Hook-and-loop fasteners are provided on the belt to secure the ends of the belt to dumbbells or other weights including barbell weight plates and kettlebells. The hip thrust belt allows the weights to hang on the outer sides of the user's hip and thereby increases the effort required to perform hip raising exercises. Hip raising exercises are believed to strengthen the gluteal and hamstring muscles.

20 Claims, 12 Drawing Sheets

(56) References Cited

U.S. PATENT DOCUMENTS 3,920,008 A * 11/1975 Lehman ..... A61F 5/03 128/96.1
4,054,952 A * 10/1977 Swallow ..... A41D 13/1209 2/338
4,120,052 A * 10/1978 Butler ..... A41D 13/065 2/16
4,273,130 A * 6/1981 Simpson ..... A61B 17/1322 128/DIG. 15
4,303,239 A * 12/1981 Walsh, Jr. ..... A63B 21/0603 482/105
4,351,526 A * 9/1982 Schwartz ..... A63B 21/0726 482/105
4,572,167 A * 2/1986 Brunswick ..... A61F 5/028 2/44
4,621,648 A * 11/1986 Ivany ..... A43B 5/00 602/27
4,706,957 A * 11/1987 Jackson ..... A63B 69/3608 473/207
4,815,731 A * 3/1989 Suarez ..... A63B 21/055 482/124
4,829,989 A * 5/1989 Dearner ..... A61F 5/02 602/19
4,833,730 A * 5/1989 Nelson ..... A61F 5/028 2/44
4,911,432 A * 3/1990 Walden ..... A63B 67/10 273/DIG. 14
4,964,401 A * 10/1990 Taigen ..... A61F 5/028 128/876
4,968,027 A * 11/1990 Anderson ..... A61F 5/028 2/322
4,984,786 A * 1/1991 Lemke ..... A63B 21/4001 482/105
5,036,864 A * 8/1991 Yewer, Jr. ..... A44B 11/12 128/876
5,046,488 A * 9/1991 Schiek, Sr. ..... A61F 5/028 602/19
5,096,190 A 3/1992 Montgomery
5,102,123 A * 4/1992 Roark ..... A63B 21/4001 482/105
5,105,806 A * 4/1992 Woodhouse ..... A61F 5/028 128/112.1
5,147,261 A * 9/1992 Smith ..... A61F 5/028 2/338
5,147,267 A * 9/1992 Kunewalder ..... A63B 21/0004 482/142
5,158,510 A * 10/1992 Lemire ..... A63B 21/4001 482/51
5,244,206 A 9/1993 Clark et al.
5,279,386 A * 1/1994 Cearley ..... A62B 35/0031 119/907
5,316,022 A * 5/1994 Schiek, Sr. ..... A61F 5/028 128/876
5,334,134 A * 8/1994 Saunders ..... A41D 13/0525 128/100.1
5,372,575 A * 12/1994 Sebastian ..... A61F 5/012 128/DIG. 20
5,465,428 A * 11/1995 Earl ..... A63B 21/0552 2/227
5,528,771 A * 6/1996 Yudin ..... A61F 5/028 128/112.1
5,529,556 A * 6/1996 Segarra ..... A63B 69/0028 224/259
5,548,843 A * 8/1996 Chase ..... A41D 13/0525 2/102
5,586,969 A * 12/1996 Yewer, Jr. ..... A61F 5/028 128/101.1
5,591,122 A * 1/1997 Yewer, Jr. ..... A61F 5/028 128/100.1
5,693,006 A * 12/1997 Slautterback ..... A61F 5/028 602/19
5,711,747 A * 1/1998 Steinback ..... A63B 21/0004 482/122
5,728,056 A * 3/1998 Seriguchi ..... A61F 5/028 602/19
5,769,808 A * 6/1998 Matthijs ..... A61F 5/0118 602/63
5,797,823 A 8/1998 Gouvis, II
5,820,575 A * 10/1998 Cabrera ..... A61F 5/028 602/19
5,997,494 A 12/1999 Watkins et al.
D422,709 S * 4/2000 Caswell ..... D2/624
6,053,883 A * 4/2000 Schiek, Sr. ..... A61F 5/028 602/19
6,099,490 A * 8/2000 Turtzo ..... A61F 5/028 2/311
6,336,908 B1 * 1/2002 Slautterback ..... A41F 9/002 2/312
6,419,652 B1 * 7/2002 Slautterback ..... A61F 5/028 128/96.1
D464,686 S 10/2002 Silveira et al.
6,551,221 B1 * 4/2003 Marco ..... A63B 21/0004 280/600
6,585,673 B1 * 7/2003 Bass ..... A61F 7/02 128/845
7,077,794 B1 * 7/2006 Bray ..... A41D 13/0525 482/111
7,426,754 B2 * 9/2008 Chun ..... A41C 1/003 2/46
7,520,844 B1 * 4/2009 Flynn ..... A63B 21/065 482/105
7,744,510 B1 * 6/2010 Chen ..... A63B 21/22 482/110
D631,924 S 2/2011 Baldwin
7,931,571 B2 * 4/2011 Bernardoni ..... A61F 5/0102 482/124
D753,244 S 4/2016 Hovey
9,931,532 B2 * 4/2018 Castaneda ..... A63B 21/4009
9,931,536 B2 4/2018 Azevedo et al.
2005/0065000 A1 3/2005 Reinhart
2009/0247369 A1 * 10/2009 Chang ..... A63B 21/06 482/49
2010/0062911 A1 * 3/2010 Stone ..... A63B 21/065 482/92
2016/0167833 A1 6/2016 De Cordova
2017/0326403 A1 * 11/2017 Castaneda ..... A63B 23/02
2019/0116904 A1 * 4/2019 Popoca Perez ..... A41F 1/002
2019/0282885 A1 9/2019 Popenhagen
2021/0322823 A1 * 10/2021 Schmidt ..... A63B 21/4009

* cited by examiner

HIP THRUST BELT

BACKGROUND OF THE INVENTION

Field of the Invention

The present invention relates to fitness equipment, and more particularly, to a belt for performing hip thrust and glute bridge exercises that has a simple structure, facilitates easy storage, and provides convenient operation.

Description of the Prior Art

The advanced development of society is causing the lives of people of the present day to become increasingly busy and stressful. In particular, general office workers are mostly unable to find the time to go outdoors to exercise, meaning the majority are only able to make use of the little time they have after work hours to do simple callisthenic exercises to strengthen and stretch muscles and increase the body's metabolism function. Hip thrusts and glute bridges are one such type of callisthenic exercises.

Hip raising exercises such as the hip thrust and glute bridge are widely believed to be useful in strengthening the gluteal and hamstring muscles and, more generally, the muscles of the legs, hips and lower back. These exercises are limited however, by the inability to readily increase the difficulty of the exercises by the addition of moderate weights. Due to the hip-raising nature of these movements, effective devices or machines that allow for loading of a user's hips during the exercises have yet to be developed. Thus, there is a need in the art for an effective means of increasing the difficulty of hip raising exercises through the addition of moderate weights to the exercise.

SUMMARY OF THE INVENTION

The present invention is used to increase the effort required to perform hip thrust and glute bridge style exercises. In recent years, hip raising exercises such as the hip thrust and glute bridge have been widely adopted by fitness enthusiasts to improve physical conditioning.

An exerciser performs glute bridge exercises by lying on a floor with his or her legs and arms outstretched. The user then bends his or her knees upwardly until they are touching or within a few inches of the user's outstretched fingertips. This is the starting position. To perform the exercise, the exerciser then raises his or her hips until his or her back and legs are elevated in a straight line from the shoulders (on the ground) to the knees (elevated) and thereafter returns to the rest position. The related hip thrust exercise is similar except that an exerciser starts the exercise by sitting on the floor with his or her shoulder resting on an elevated surface, typically a weight bench, rather than on the floor. It should be noted that the arms are not used to perform these exercises. All effort comes from the motion of raising the hips. Hip thrust and glute bridge style exercises are believed to primarily work the gluteal and hamstring muscles and, more generally, to improve leg, hip and lower back strength. The difficulty of these exercises may be increased by holding a weight across the hips.

The present invention provides a belt, referred to as a hip thrust belt, which allows a user to easily load their hips with weights in order to increase the effort required to perform hip thrust and glute bridge style exercises. The hip thrust belt has a simple structure that can accommodate a variety of weights as commonly found in home or commercial gyms, facilitates easy storage, and provides convenient operation.

The hip thrust belt of the present invention features a flexible supporting pad, upon which is disposed a flexible belt. A variety of weights such as dumbbells, barbell weight plates, kettlebells and bags filled with sand or metal shot, may be suspended from opposing ends of the belt. Elastic bands may also be used in place of weights. Hook and loop (Velcro) style fasteners are used to secure the weights to the flexible belt. The flexible supporting pad, to which the flexible belt is attached, is configured to lay or rest across a user's hips, such that the weights suspended from the flexible belt hang along the sides of the user's hips. The flexible supporting pad may use hook and loop fasteners to allow the supporting pad to be folded over the flexible belt. Alternatively, magnets may be used in place of the hook and loop fasteners on the flexible supporting pad to secure the pad when folded over the flexible belt.

The flexible supporting pad may also be equipped with a layer of high friction, anti-slip material on the face of the pad which rests across a user's hips to better secure the pad, i.e. to prevent slipping of the pad on a user's body during exercise. Similarly, the flexible belt may be equipped with high friction, anti-slip layers of material to better secure the weights.

The hip thrust belt disclosed in the present invention is not only structurally simple but also facilitates storage and carrying thereof. When in use, coupled with dumbbells or other weights hung on the outer sides of a user's hip, the hip thrust belt enables using the weight of the dumbbells to increase the resisting force on the user as they raise their hips when performing hip thrust or glute bridge exercises, thereby improving the exercising effect on the user's midriff and hip muscles.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

The present invention will now be described more fully hereinafter with reference to the accompanying drawings, in which preferred embodiments of the invention are shown. The invention however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Figure 1:
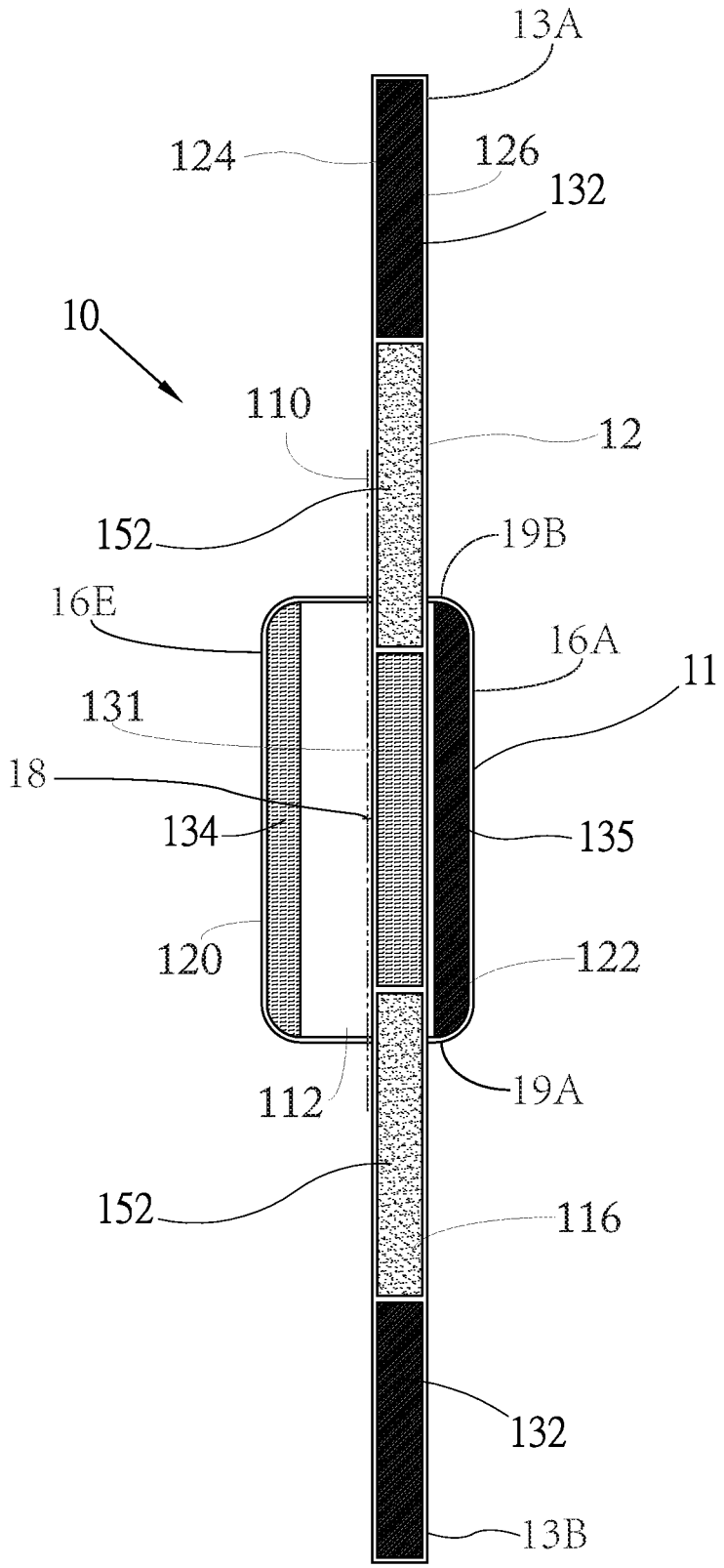
FIG. 1 is a structural view of the front side of a hip thrust belt of the present invention.
Figure 2:
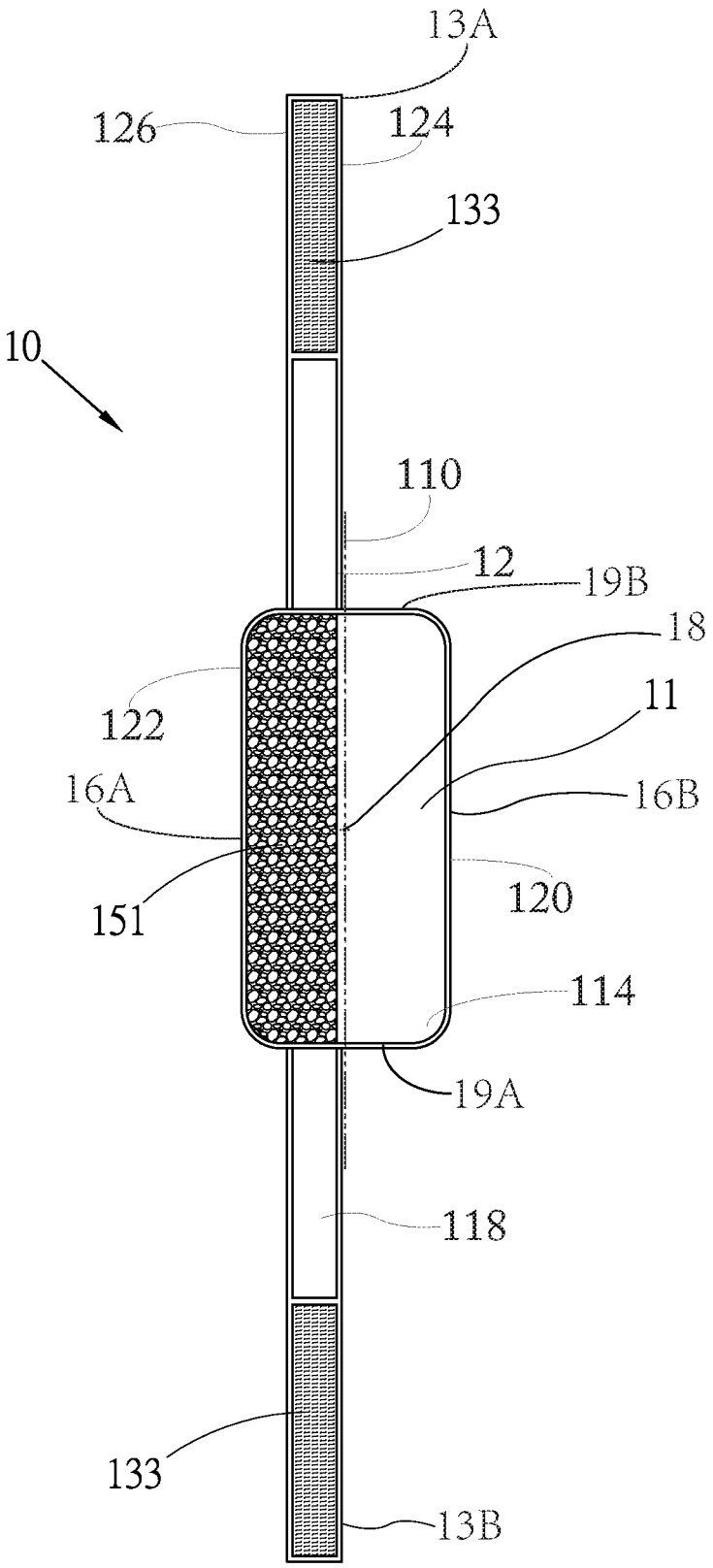
FIG. 2 is a structural view of the reverse side of the hip thrust belt of the present invention.
Figure 3:
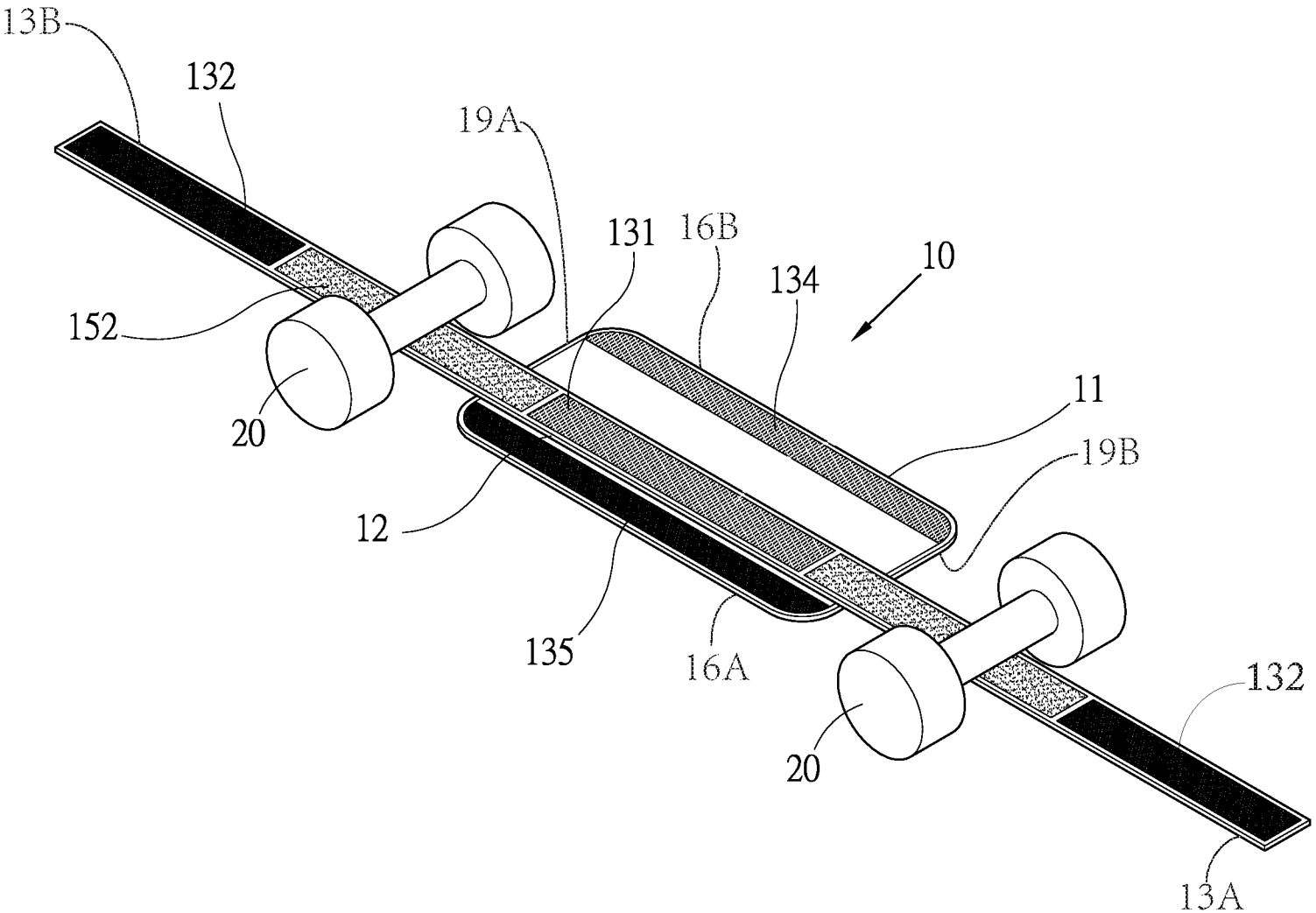
FIG. 3 is a three-dimensional structural view of the hip thrust belt of the present invention.

The hip thrust belt 10 of the present invention assists an exerciser or user in holding a weight across the user's hips when performing glute bridge or hip thrust style exercises. Referring to FIGS. 1 to 3, the hip thrust belt 10 includes a flexible supporting pad 11 and a flexible belt 12. The flexible supporting pad 11 has a first face 112, a second face 114, a midline or first axis 110, a first edge 120 and a second edge 122. The midline or first axis 110 divides the flexible supporting pad 11 into a first side 16A and a second side 16B. The flexible belt 12 has a first face 116, a second face 118, a first edge 124 and a second edge 126, and a first end 13A and a second end 13B.

The hip thrust belt of the present invention makes use of hook and loop style fasteners, comprising hook fasteners and loop fasteners, which are pressed together to form a connection between fabric elements. Hook and loop fasteners are commonly known by the trade name "Velcro."

The flexible supporting pad 11 of the hip thrust belt 10 includes a first hook fastener 134 disposed on the first face 112, on the second side 16B, adjacent to the first edge 120. A first loop fastener 135 is disposed on the first face 112 on the first side 16A, adjacent to the second edge 122.

In the exemplary embodiment, the second face 118 of the flexible belt 12 is disposed on the first face 112 of flexible supporting pad 11 on the first side 16A of the flexible supporting pad 11, intermediate the midline or first axis 110 and the first loop fastener 135. Alternatively, the flexible belt 12 may also be disposed on the second side 16B of the flexible supporting pad 11 intermediate the midline or first axis 110 and the first hook fastener 134. In the exemplary embodiment, the flexible belt 12 is disposed on the flexible supporting pad 11, such that the first end 13A and the second end 13B of the flexible belt 12 extend equidistantly from a midpoint 18 of the flexible supporting pad, i.e. the flexible belt 12 is centered, lengthwise, on the flexible supporting pad 11.

The flexible belt 12 includes a first hook fastener 131 of preset length provided on the first face 116 of the flexible belt 12 at a section overlapping the flexible supporting pad 11. A first loop fastener 132 of preset length is provided on the first face 116 of the flexible belt 12 at the first end 13A and the second end 13B of the flexible belt 12. A second hook fastener 133 of preset length is provided on the second face 118 of the flexible belt 12 at each of the first and second ends 13A and 13B of the flexible belt 12. Each of the first and second ends 13A and 13B of the flexible belt 12 has a length that is preset to extend beyond the corresponding side of the flexible supporting pad 11 and is sufficient to secure a weight and be folded over onto the flexible supporting pad 11.

Because the hip thrust belt 10 of the present invention is primarily structured from the flexible supporting pad 11 and the flexible belt 12, not only is the structure simple, but it also provides the choice of using either a folding up method or a rolling up method to facilitated storage of the hip thrust belt 10 and carrying thereof.

Figure 4:
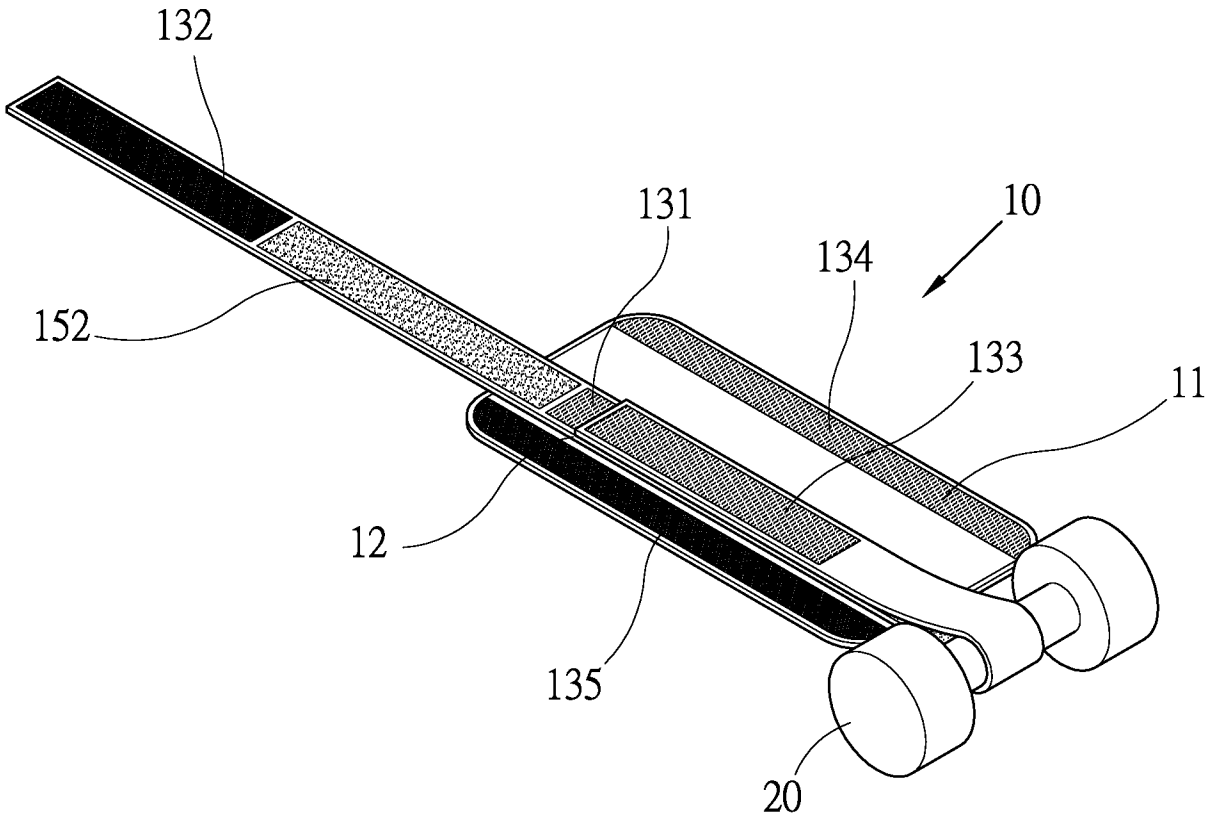
FIG. 4 is a schematic view showing the state when one end of a flexible belt is press fitted to a flexible supporting pad according to the present invention.
Figure 5:
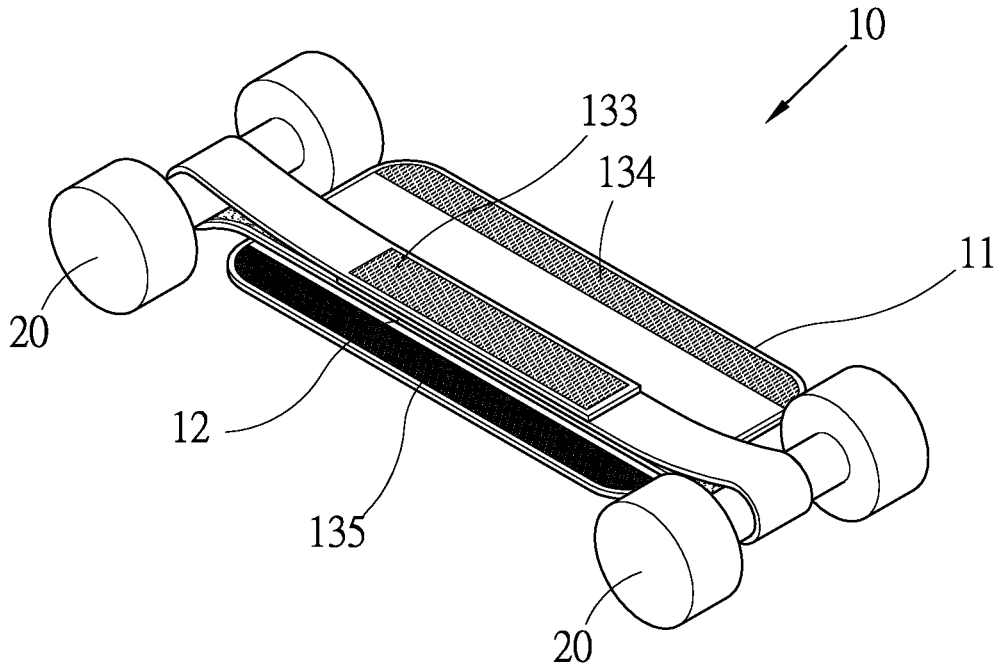
FIG. 5 is a schematic view showing the state when the other end of the flexible belt is press fitted to the flexible supporting pad according to the present invention.

With reference to FIGS. 3-5, when in use, the hip thrust belt 10 of the present invention allows two dumbbells 20 to be respectively placed on the flexible belt 12 on either end 19 of the flexible supporting pad 11, as shown in FIG. 3, whereupon the first loop fastener 132 at one end 13A of the flexible belt 12 is press fastened on the first hook fastener 131, as shown in FIG. 4, causing one of the dumbbells 20 to be wrapped round and securely fastened on one end 19B of the flexible supporting pad 11.

With continued reference to FIGS. 3-5, the first loop fastener 132 at the second end 13B of the flexible belt 12 is then press fastened on the second hook fastener 133 on the first end 13A, thereby causing the other dumbbell 20 to be wrapped round and securely fastened on the other end 19A of the flexible supporting pad 11, as shown in FIG. 5.

Figure 6:
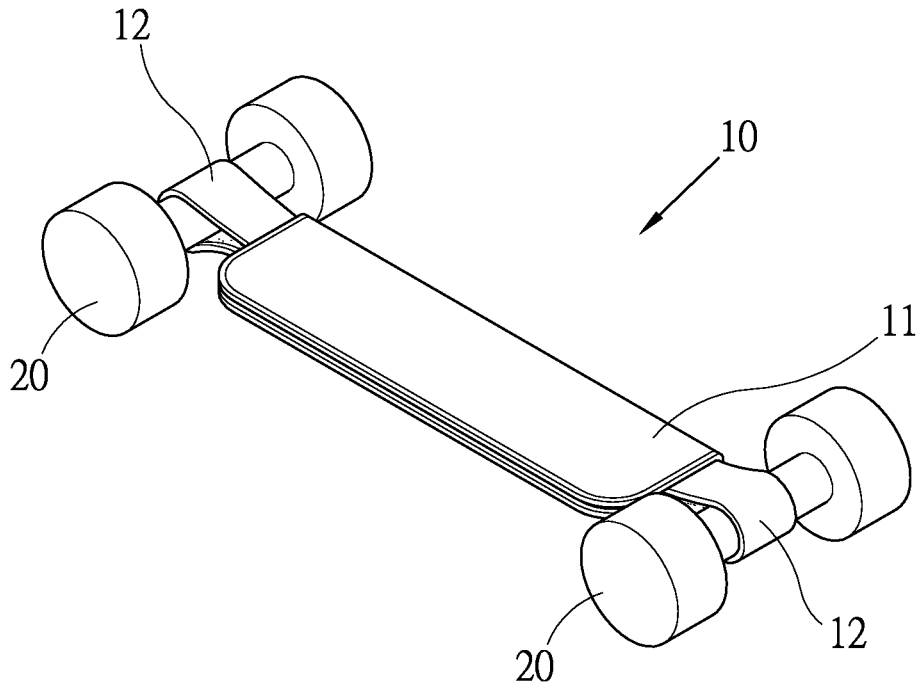
FIG. 6 is a schematic view showing the state when the flexible supporting pad is clasped round the two ends of the flexible belt according to the present invention.

In actual use, the width of the flexible supporting pad 11 is at least twice (or more than double) the width of the flexible belt 12 and the flexible belt 12 is disposed on one side (either 16A or 16B) of the flexible supporting pad 11 adjacent the midline or first axis 110, which enables folding over the other side of the flexible supporting pad 11 toward the side provided with the flexible belt 12, as shown in FIG. 6, thereby enclosing the first and second faces, 116 and 118, of the flexible belt 12 and preventing the first and second ends, 13A and 13B, of the flexible belt 12 from arbitrarily coming loose.

Figure 7:
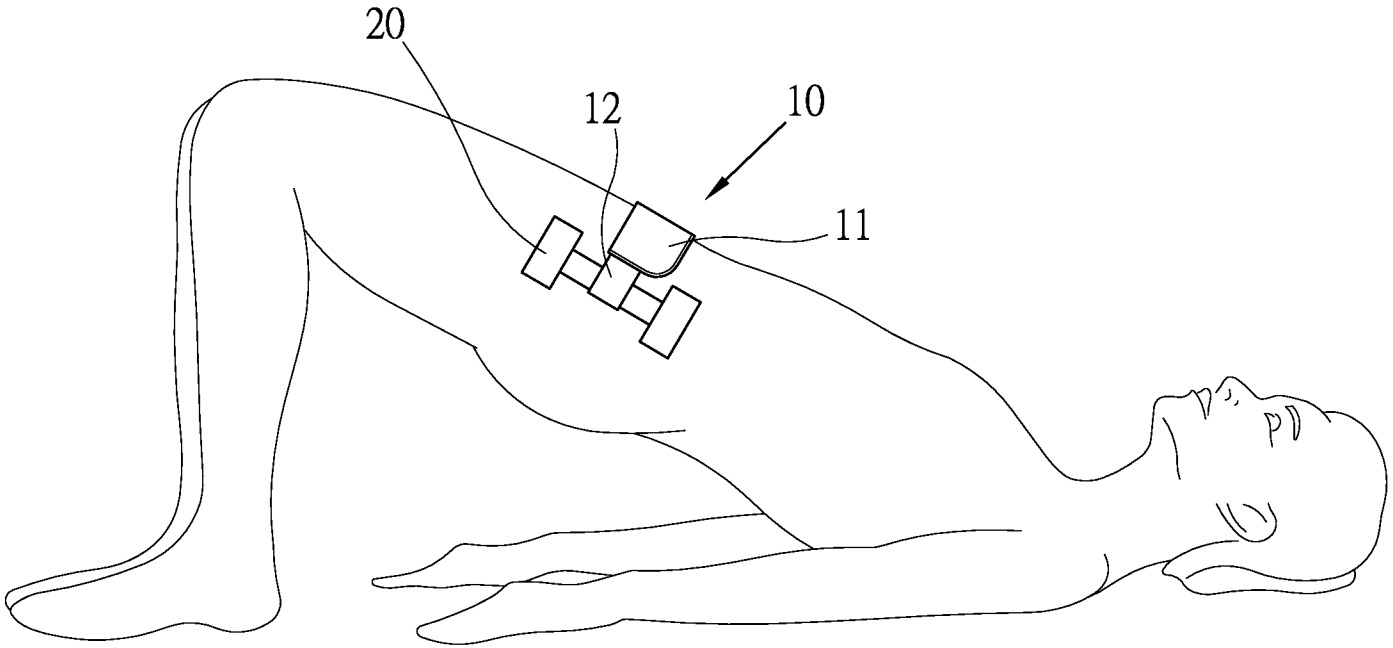
FIG. 7 is a schematic view showing an operating state of the hip thrust belt in use paired with dumbbells according to the present invention.

With reference to FIG. 7, the hip thrust belt 10 together with the dumbbells 20 on the two ends, 19A and 19B, of the flexible supporting pad 11 enables placement of the flexible supporting pad 11 on a user's lower abdomen area causing the dumbbells 20 to be correspondingly disposed and hang on the outer sides of the user's hips. The weight of the dumbbells 20 on the two ends 19A and 19B of the flexible supporting pad 11 increases the resisting force on the user as they raise their buttocks to straighten up their body, thereby improving the exercising effect and effectiveness on the user's midriff and hip muscles.

Figure 8:
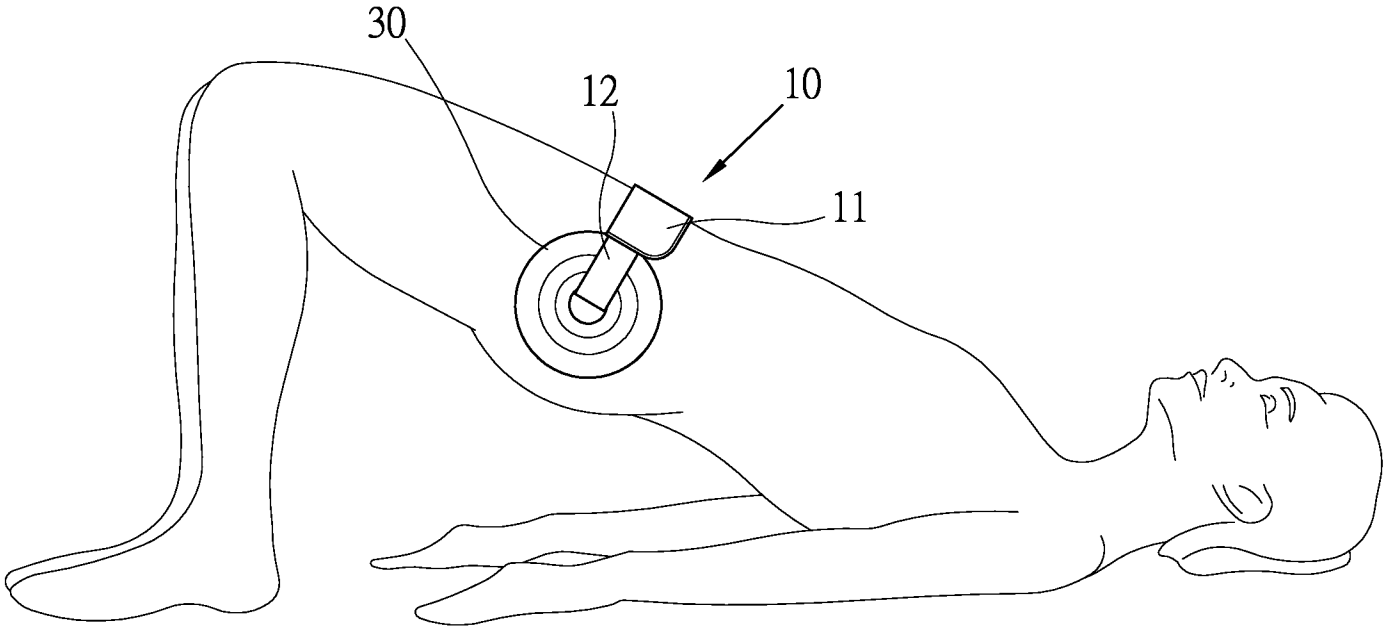
FIG. 8 is a schematic view showing an operating state of the hip thrust belt in use paired with weight plates according to the present invention.
Figure 9:
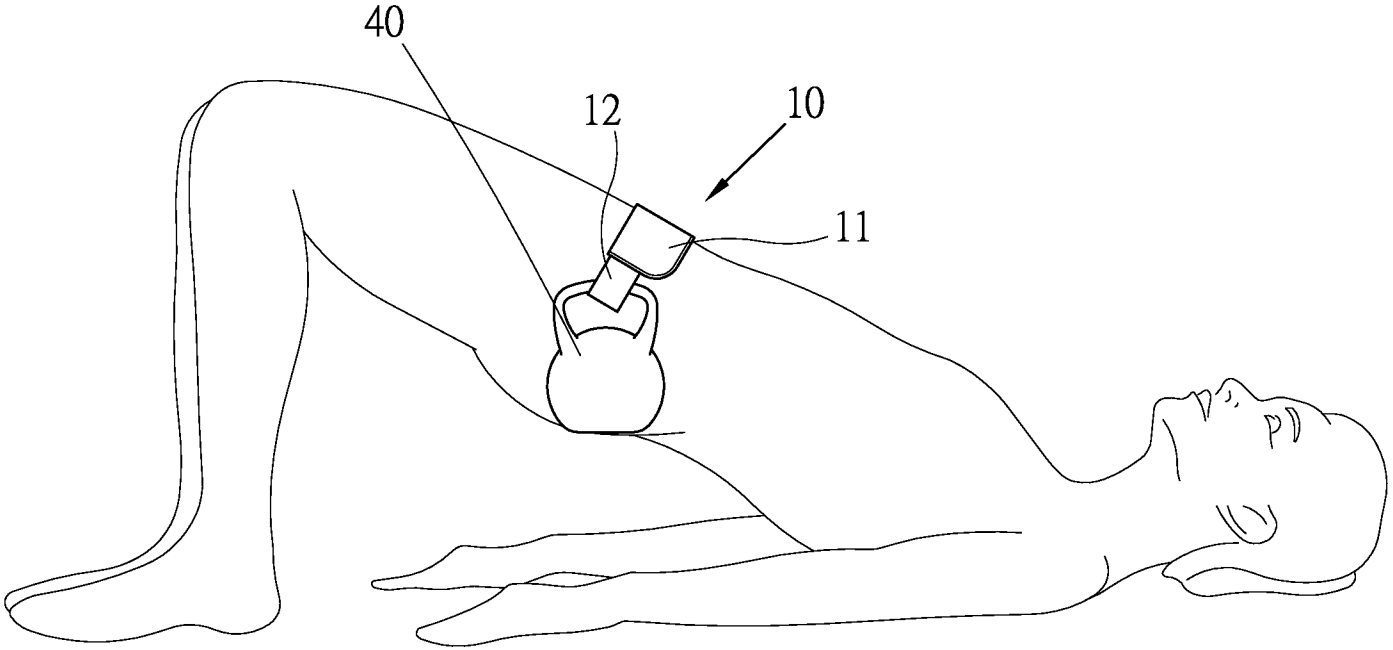
FIG. 9 is a schematic view showing an operating state of the hip thrust belt in use paired with kettlebells according to the present invention.
Figure 10:
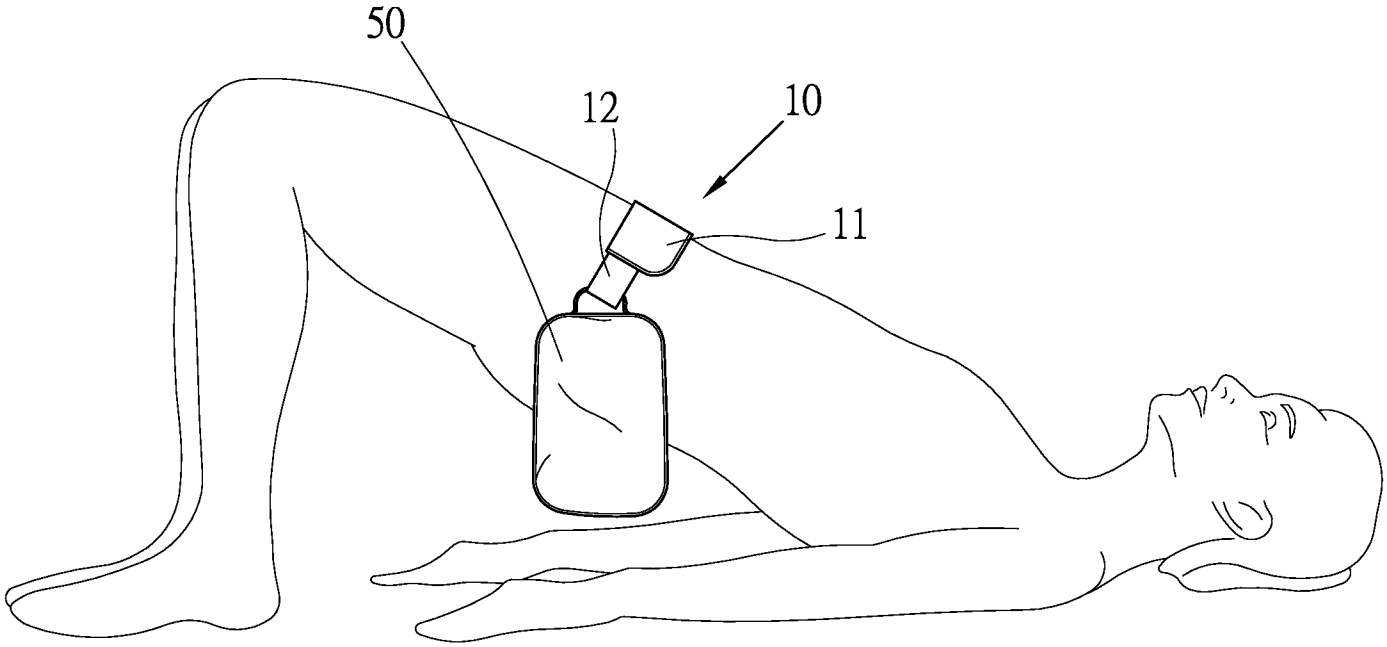
FIG. 10 is a schematic view showing an operating state of the hip thrust belt in use paired with sandbags according to the present invention.
Figure 12:
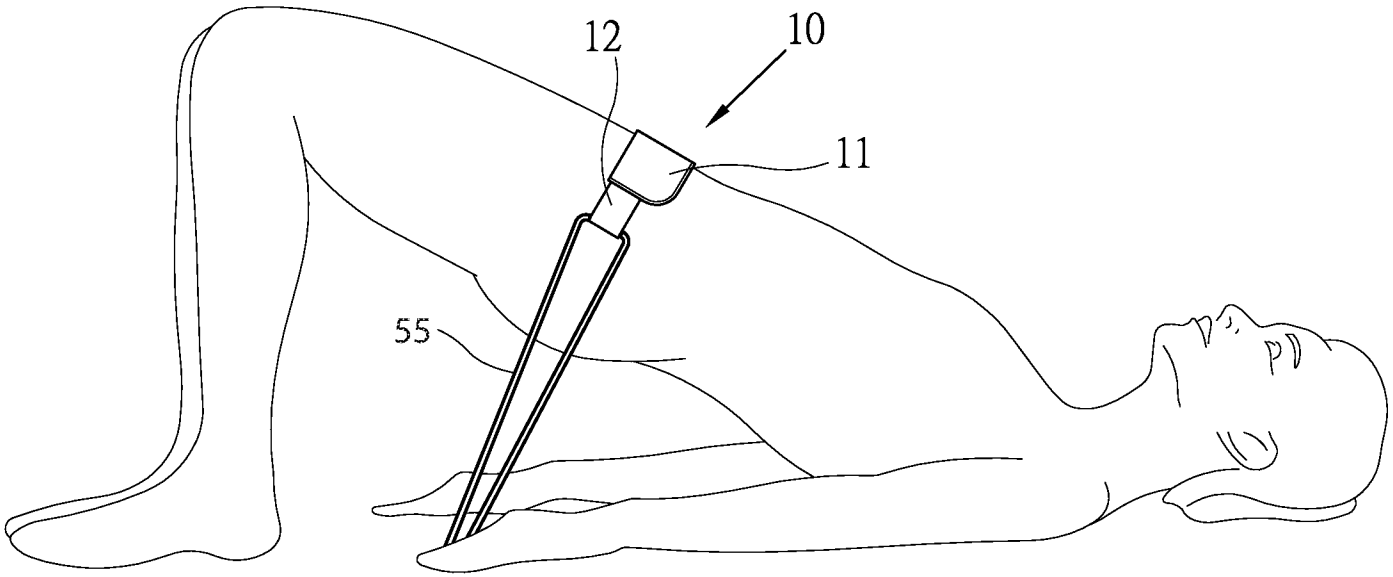
FIG. 12 is a schematic view showing an operating state of the hip thrust belt in use paired with elastic bands according to the present invention.

It is understood that when the user is using the hip thrust belt 10 of the present invention in a lying down position, the flexible supporting pad 11 is placed on the user's lower abdomen area, and then the flexible belt 12 is used to successively wrap around and securely fasten the two dumbbells 20 to the two sides of the flexible supporting pad 11. After finishing use of the dumbbells 20, the user only needs to successively pull apart the first and second ends, 13A and 13B, of the flexible belt 12 from the flexible supporting pad 11 to quickly remove the dumbbells 20. The hip thrust belt 10 of the present invention can also be used with barbell weight plates 30, as shown in FIG. 8; or with kettlebells 40, as shown in FIG. 9; or with sandbags equipped with loops 50, as shown in FIG. 10; or with elastic bands 55, as shown in FIG. 12. These types of weights are attached to the hip thrust belt 10 by threading or sliding the first and second ends, 13A and 13B, of the flexible belt through the holes in barbell weight plates or the handles of kettlebells or the loops of sandbags so equipped.

Figure 11:
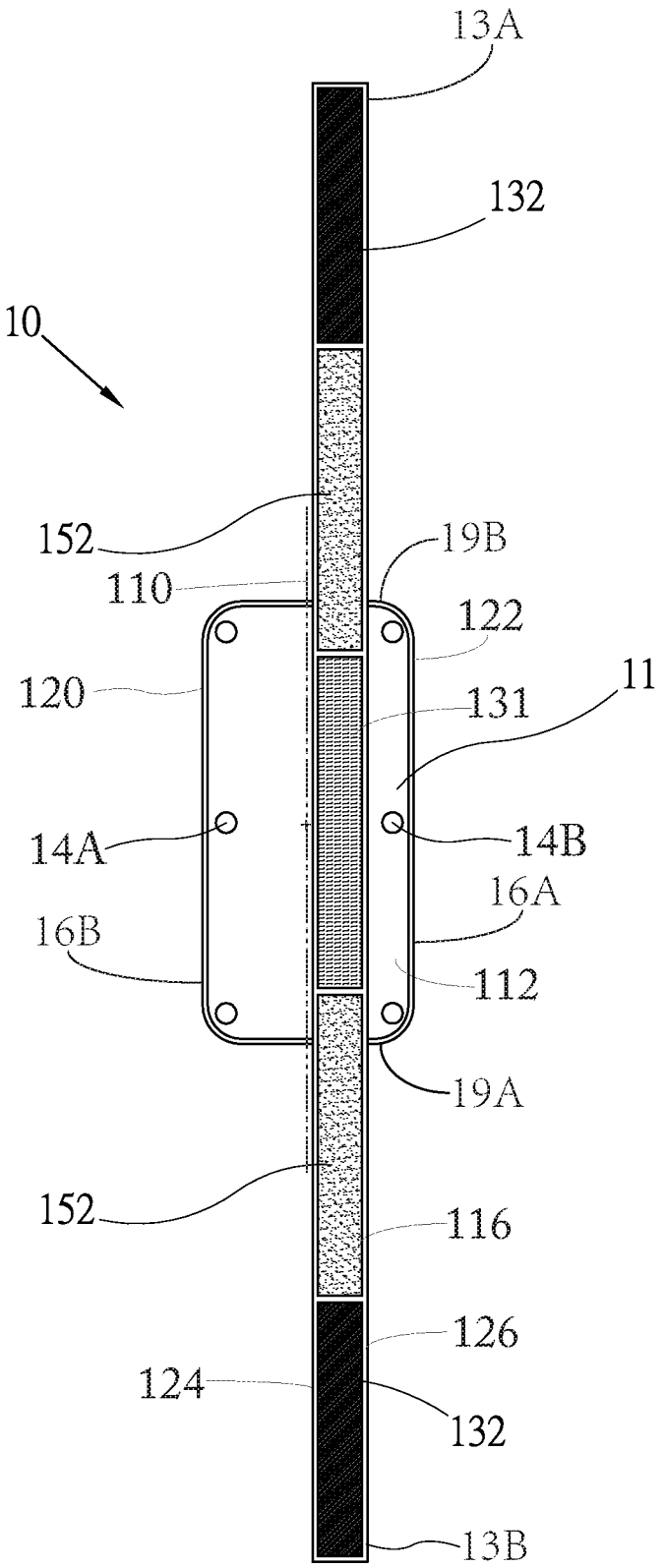
FIG. 11 is a structural view of the front side of another embodiment of the hip thrust belt of the present invention.

With reference to FIG. 11, in the hip thrust belt 10 of the present invention, the width of the flexible supporting pad 11 is more than double the width of the flexible belt 12, and the flexible belt 12 may be disposed adjacent to either side of the midline or first axis 110 of the flexible supporting pad 11. In an alternative embodiment, the flexible supporting pad 11 is provided with at least one first magnetic member 14A disposed adjacent to the first edge 120, which corresponds to at least one second magnetic member 14B disposed adjacent to the second edge 122, where the magnetic members 14A and 14B are configured with opposite poles so as to secure the two sides, 16A and 16B, of the flexible supporting pad 11, when the sides are folded over to secure the flexible belt 12.

In another embodiment of the hip thrust belt 10 of the present invention, either a portion of the second face 114 of the flexible supporting pad 11, as shown in FIG. 2, or the entirety of the second face 114, may be provided with a layer of anti-slip material 151. The layer of anti-slip material 151 is used to increase friction between the hip thrust belt 10 so as to reduce the likelihood of the hip thrust belt 10 arbitrarily shifting during the process of performing hip thrust exercises.

With reference to FIGS. 1, 3 and 11, the flexible belt 12 may also be provided with layers of anti-slip material 152, where the anti-slip material is disposed on the first face 116 of the flexible belt 12 in between the loop fasteners 132 at each of the first end 13A and the second end 13B of the flexible belt 12 and the hook fastener 131 at approximately the center or midpoint 18 of the flexible belt 12. The anti-slip material layer 152 is used to improve the retention of dumbbells 20, or other weights, thereby reducing that likelihood of the dumbbells, or other weights, arbitrarily shifting during the process of performing hip thrust exercises.

The hip thrust belt 10 of the present invention has a simple structure that facilitates storage and carrying. When in use, coupled with weights hung on the outer sides of a user's hip, the hip thrust belt 10 enables using the weights to increase the resisting force on the user as they raise their buttocks to straighten up their body while performing hip thrust exercises, thereby improving the exercising effect on the user's gluteal and hamstring muscles. In addition, first and second layers of anti-slip material may be used to prevent the possibility of the hip thrust belt and weights from arbitrarily shifting during the process of repeatedly straightening up the body, which correspondingly increases reliability and safety during use. The hip thrust belt of the present invention will generally be made of fabric materials and its component parts assembled by means of sewing. Those skilled in the art will understand that flexible non-fabric materials may be used in place of fabrics for all or some of the component parts of the hip thrust belt and that adhesives, rivets or other means of attachment may be used in place of sewing.

The hip thrust belt 10 of the present invention is intended to be used while performing hip raising exercises such as glute bridges and hip thrusts. To perform a glute bridge exercise, an exerciser or user first lays on a floor with his or her legs and arms outstretched. The exercise then places the hip thrust belt 10 of the present invention across his or her hips. The exerciser then bends his or her knees upwardly until they are touching or within a few inches of the user's outstretched fingertips. This is the starting position. To perform the exercise, the exerciser then raises his or her hips until his or her back and upper legs are elevated in a straight line from the shoulders (on the ground) to the knees (elevated) and thereafter returns to the rest position. The related hip thrust exercise is similar except that an exerciser starts the exercise by sitting on the floor and then leans his or her shoulder on an elevated surface which is typically a weight bench. After placing the hip thrust belt 10 of the present invention across his or her hips, the exerciser raises his or her hips until his or her back and upper legs are inline. It should be noted that the arms are not used to perform these exercises. All effort comes from the motion of raising the hips. Hip thrust and glute bridge style exercises are believed to primarily work the gluteal and hamstring muscles and, more generally, to improve leg, hip and lower back strength.

The embodiments of the present invention described herein are merely illustrative of the principles of the invention and that a wide variety of modifications thereto may be made by persons skilled in the art without departing from the spirit and scope of the invention as set forth in the following claims.

What is claimed is:

1. A hip thrust belt, comprising:

a flexible supporting pad having a first face and a second face;

a flexible belt having a first face, a second face, a first end and a second end;

wherein, the width of the flexible supporting pad is at least twice the width of the flexible belt;

wherein the second face of the flexible supporting belt is disposed on the first face of the flexible supporting pad and on a side of a midline of the flexible supporting pad, and the first end and second end of the flexible belt extend from the flexible supporting pad and have a length sufficient to secure a weight and fold over onto the flexible supporting pad;

a first hook fastener disposed on the first face of the flexible belt disposed on the flexible supporting pad;

first loop fasteners disposed on the first face of the flexible belt at each of the first end and the second end;

second hook fasteners disposed on the second face of the flexible belt at each of the first end and the second end; and wherein, when the first end of the flexible belt is folded over, the first loop fastener at the first end engages the first hook fastener and wherein, when the second end of the flexible belt is folded over, the first loop fastener on the second end engages the second hook fastener on the first end.

2. The hip thrust belt of claim 1, wherein the flexible supporting pad includes a hook fastener disposed on the first face on a side of the midline and a corresponding loop fastener disposed on the first face on an opposite side of the midline, wherein the flexible supporting pad can be folded and secured in the folded condition by the hook fasteners engaging the loop fasteners.

3. The hip thrust belt of claim 2, wherein the flexible supporting pad includes at least one magnetic element disposed on the first face on a side of the midline and at least one corresponding magnetic element having an opposite pole disposed on the first face on an opposite side of the midline, wherein the flexible supporting pad can be folded and secured in the folded condition by the magnetic elements.

4. The hip thrust belt of claim 1, wherein the flexible supporting pad includes a layer of anti-slip material on the second face.

5. The hip thrust belt of claim 1, wherein the flexible supporting pad includes a layer of anti-slip material on the second face on a side of the midline upon which is disposed the flexible belt.

6. The hip thrust belt of claim 1, wherein a layer of anti-slip material is disposed on each of the first end and second end of the flexible belt between the first loop fastener and the first hook fastener.

7. A hip thrust belt, comprising:

a flexible supporting pad having a first face and a second face;

a flexible belt having a first face, a second face, a first end and a second end;

wherein the second face of the flexible supporting belt is disposed on the first face of the flexible supporting pad, and the first end and second end of the flexible belt extend from the flexible supporting pad and have a length sufficient to secure a weight and fold over onto the flexible supporting pad;

a first hook fastener disposed on the first face of the flexible belt disposed on the flexible supporting pad;

first loop fasteners disposed on the first face of the flexible belt at each of the first end and the second end;

second hook fasteners disposed on the second face of the flexible belt at each of the first end and the second end; and wherein, when the first end of the flexible belt is folded, the first loop fastener at the first end engages the first hook fastener and wherein, when the second end of the flexible belt is folded, the first loop fastener on the second end engages the second hook fastener on the first end.

8. The hip thrust belt of claim 7, wherein the flexible belt is disposed on the first face of the flexible supporting pad above or below a midline of the flexible supporting pad.

9. The hip thrust belt of claim 7, wherein the flexible supporting pad includes a first hook fastener disposed on the first face above the midline and a first, corresponding, loop fastener disposed on the first face below the midline, wherein the flexible supporting pad can be folded and secured in the folded condition by the first hook fasteners engaging the first loop fasteners.

10. The hip thrust belt of claim 7, wherein the flexible supporting pad includes at least one magnetic element disposed on the first face above the midline and at least one corresponding magnetic element having an opposite pole disposed on the first face below the midline, wherein the flexible supporting pad can be folded and secured in the folded condition by the magnetic elements.

11. The hip thrust belt of claim 7, wherein the flexible supporting pad is provided with a layer of anti-slip material on the second face.

12. The hip thrust belt of claim 7, wherein the flexible supporting pad is provided with a layer of anti-slip material on the second face on a side of the midline upon which is disposed the flexible belt.

13. The hip thrust belt of claim 7, wherein a layer of anti-slip material is disposed on each of the first end and second end of the flexible belt between the first loop fastener and the first hook fastener.

14. A hip thrust belt, comprising:

a flexible supporting pad having a first face and a second face;

a flexible belt having a first face, a second face, a first end and a second end;

wherein the second face of the flexible supporting belt is disposed on the first face of the flexible supporting pad;

a first hook fastener disposed on the first face about a midpoint of the flexible belt;

first loop fasteners disposed on the first face of the flexible belt at each of the first end and the second end;

second hook fasteners disposed on the second face of the flexible belt at each of the first end and the second end and the first end and second end of the flexible belt extend from the flexible supporting pad and have a length sufficient to secure a weight and fold over onto the flexible supporting pad.

15. The hip thrust belt of claim 14, wherein, when the first end of the flexible belt is folded over, the first loop fastener on the first end engages the first hook fastener and wherein, when the second end of the flexible belt is folded over, the first loop fastener on the second end engages the second hook fastener on the first end.

16. The hip thrust belt of claim 14, wherein the flexible supporting pad includes a hook fastener disposed on the first face above the midline and a corresponding loop fastener disposed on the first face below the midline, wherein the flexible supporting pad can be folded and secured in the folded condition by the hook fasteners engaging the loop fasteners.

17. The hip thrust belt of claim 14, wherein the flexible supporting pad is provided with a layer of anti-slip material on the second face.

18. The hip thrust belt of claim 14, wherein the flexible supporting pad is provided with a layer of anti-slip material on the second face on a side of the midline upon which is disposed the flexible belt.

19. The hip thrust belt of claim 14, wherein a layer of anti-slip material is disposed on each of the first and second end of the flexible belt between the first loop fastener and the first hook fastener.

20. The hip thrust belt of claim 14, wherein the second face of the flexible supporting belt is disposed on the first face of the flexible supporting pad and on a side of a midline of the flexible supporting pad.

* * * * *